US008063566B2

(12) United States Patent
Kakisaka et al.

(10) Patent No.: US 8,063,566 B2
(45) Date of Patent: Nov. 22, 2011

(54) ILLUMINATION APPARATUS AND METAL VAPOR DISCHARGE LAMP

(75) Inventors: Shunsuke Kakisaka, Osaka (JP); Masanori Higashi, Kyoto (JP); Rie Tonomori, Nara (JP)

(73) Assignee: Panasonic Corporation, Osaka (JP)

( * ) Notice: Subject to any disclaimer, the term of this patent is extended or adjusted under 35 U.S.C. 154(b) by 598 days.

(21) Appl. No.: 12/097,209

(22) PCT Filed: Dec. 26, 2006

(86) PCT No.: PCT/JP2006/325848

§ 371 (c)(1),
(2), (4) Date: Jun. 12, 2008

(87) PCT Pub. No.: WO2007/074803

PCT Pub. Date: Jul. 5, 2007

(65) Prior Publication Data

US 2009/0045745 A1 Feb. 19, 2009

(30) Foreign Application Priority Data

Dec. 28, 2005 (JP) ..... 2005-379473

(51) Int. Cl.
*H01J 61/18* (2006.01)
*H01J 17/20* (2006.01)

(52) U.S. Cl. ..... 313/638; 313/113; 313/318.11; 313/116

(58) Field of Classification Search ..... 313/113, 313/116, 638, 639, 640, 641, 642, 318.11; 362/516; 315/82
See application file for complete search history.

(56) References Cited

U.S. PATENT DOCUMENTS

| | | | | |
|---|---|---|---|---|
| 4,799,135 | A * | 1/1989 | Inukai et al. | 362/516 |
| 4,935,668 | A * | 6/1990 | Hansler et al. | 315/82 |
| 5,220,237 | A * | 6/1993 | Maseki et al. | 313/113 |
| 5,221,876 | A * | 6/1993 | Bergman et al. | 315/82 |
| 5,235,498 | A * | 8/1993 | Van Dulmen et al. | 362/549 |
| 5,479,065 | A * | 12/1995 | Sugimoto et al. | 313/113 |

(Continued)

FOREIGN PATENT DOCUMENTS

JP 60-131957 9/1985

(Continued)

OTHER PUBLICATIONS

Japanese Patent Application No. 2010-107146 Office Action dated Dec. 8, 2010, 2 pages.

*Primary Examiner* — Nimeshkumar Patel
*Assistant Examiner* — Glenn Zimmerman

(57) ABSTRACT

An object of the present invention is to provide an illumination apparatus which includes an illumination fixture having an open-type reflector and a metal halide lamp, and can suppress a decrease in intensity and occurrence of glare. The illumination apparatus includes a metal halide lamp and an illumination fixture. The metal halide lamp includes an arc tube which has therein a pair of electrodes, an inner tube which houses the arc tube and has a pinch seal part at one end, and an outer tube which houses the inner tube and has a base at one end. The illumination fixture includes a reflector having a concave reflecting surface, a socket, and an attachment. In the inner tube, a diffusing part which diffuses light emitted from the arc tube is formed in an area closer to a lower end of the inner tube than a center between the pair of electrodes.

11 Claims, 9 Drawing Sheets

U.S. PATENT DOCUMENTS

| | | | | |
|---|---|---|---|---|
| 5,689,154 | A * | 11/1997 | Barthelmes et al. | 313/635 |
| 5,698,936 | A * | 12/1997 | Marien et al. | 313/318.11 |
| 5,744,901 | A * | 4/1998 | Friederichs et al. | 313/113 |
| 6,234,649 | B1 | 5/2001 | Katougi | |
| 6,469,445 | B1 * | 10/2002 | Nortrup et al. | 313/638 |
| 6,600,256 | B2 * | 7/2003 | Van Lier et al. | 313/313 |
| 6,605,888 | B1 * | 8/2003 | Waymouth et al. | 313/112 |
| 2003/0193280 | A1 | 10/2003 | Lapatovich et al. | 313/113 |
| 2004/0021420 | A1 * | 2/2004 | Tsuda et al. | 313/638 |
| 2004/0174121 | A1 * | 9/2004 | Tsuda et al. | 313/635 |
| 2005/0127807 | A1 * | 6/2005 | Arndt et al. | 313/25 |
| 2005/0184632 | A1 * | 8/2005 | Galvez et al. | 313/113 |
| 2005/0219477 | A1 * | 10/2005 | Takezawa et al. | 353/99 |
| 2006/0119245 | A1 * | 6/2006 | Arndt et al. | 313/113 |
| 2009/0103305 | A1 * | 4/2009 | Ritz | 362/294 |

FOREIGN PATENT DOCUMENTS

| | | | |
|---|---|---|---|
| JP | 61-70358 | | 5/1986 |
| JP | 4-329250 | | 11/1992 |
| JP | 6-150889 | | 5/1994 |
| JP | 06-203803 | | 7/1994 |
| JP | 6-79064 | | 11/1994 |
| JP | 7-220685 | | 8/1995 |
| JP | 7-320685 | | 12/1995 |
| JP | 9-115303 | | 5/1997 |
| JP | 11-25919 | | 1/1999 |
| JP | 11-96973 | | 4/1999 |
| JP | 2002-231185 | | 8/2002 |
| JP | 2003-282022 | | 10/2003 |
| JP | 2005-174936 | | 6/2005 |
| KR | 1995-0007895 | | 4/1995 |
| WO | WO 2006001166 | A1 * | 1/2006 |

* cited by examiner

ILLUMINATION APPARATUS AND METAL VAPOR DISCHARGE LAMP

TECHNICAL FIELD

The present invention relates to an illumination apparatus and a metal vapor discharge lamp.

BACKGROUND ART

Conventionally, a metal vapor discharge lamp that has characteristics of high intensity, high efficiency, and a long life, such as a metal halide lamp is widely used in various places because of the above characteristics. Recently, a low-power-consumption metal halide lamp which is compact and has high color rendering properties has been developed, and such a metal halide lamp is used as, for example, a light source of an illumination apparatus (a so-called spotlight) which illuminates articles on display such as a commercial product or the like in a spot manner.

A conventional illumination apparatus includes, in addition to the above metal halide lamp, a reflector having a concave reflecting surface to reflect light emitted from the metal halide lamp in a desired direction. As the reflector, a so-called closed-type reflector is typically used, which has an opening (light extracting part) closed with, for example, a front glass plate. This is because of the following reason. If the metal halide lamp that does not take explosion-proof measures is damaged by some reasons, a fragment of the damaged metal halide lamp is prevented from scattering to outside of the reflector.

On the other hand, because the metal halide lamp has high intensity, if direct light emitted from the metal halide lamp enters human eyes, glare is caused. Therefore, concavo-convex processing for diffusing light is performed on the front glass plate, or a glare cap for shielding light emitted from the metal halide lamp is provided on the front glass plate, for example (such as a patent document 1).

Patent Document 1: Japanese Published Patent Application No. H11-96973

DISCLOSURE OF THE INVENTION

Problems the Invention is Going to Solve

In recent years, in addition to the above illumination apparatus that uses the closed-type reflector, an illumination apparatus that uses a so-called open-type reflector whose opening is not closed has been requested. Some of metal halide lamps include, for example, an explosion-proof quartz sleeve and an outer tube made from a hard glass for surrounding an arc tube. Such metal halide lamps can be used by being built into the open-type reflector. However, because the open-type reflector does not include a front glass, the conventional measures against glare such as the concavo-convex processing or the technique of the glare cap cannot be used.

In view of the above problem, an object of the present invention is to provide an illumination apparatus that can suppress glare even if the open-type reflector is used, and a metal vapor discharge lamp that can suppress glare even if being built into the open-type reflector.

Means of Solving the Problems

Out of light emitted from the arc tube, light which goes toward an opening of the reflector without being reflected by the reflecting surface is illuminated from the illumination apparatus. When the light enters human eyes, glare is caused.

The above-mentioned object can be achieved by an illumination apparatus, comprising: a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein the outer tube has a light reducing unit provided therein that reduces an amount of light emitted from the arc tube in directions except toward the reflecting surface, so that an amount of light emitted in the directions and passing through the outer tube is smaller than an amount of light emitted in the directions and entering the airtight container.

With the above-mentioned construction, the amount of the light emitted from the metal vapor discharge lamp in the directions except toward the reflecting surface of the reflector can be reduced.

The "light reducing unit" includes, for example, a concavo-convex diffusing part, a surrounding member that has a light shielding function, and the like.

Also, the above-mentioned object can be achieved by an illumination apparatus, comprising: a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein at least a part of the airtight container is a diffusing part that diffuses light emitted from the arc tube in directions except toward the reflecting surface, the part being away from the pinch seal part beyond an imaginary plane that passes through a substantial center between tips of the pair of electrodes and is substantially orthogonal to a longitudinal axis of the metal vapor discharge lamp.

With the above-mentioned construction, the light emitted from the arc tube in the directions except toward the reflecting surface is diffused by the diffusing part. As a result, the amount of the light emitted from the metal vapor discharge lamp in the directions except toward the reflecting surface can be reduced.

Also, the airtight container is composed of a quartz glass, and the diffusing part is composed of concavity and convexity formed on an inner surface and/or an outer surface of the airtight container. Moreover, the pair of electrodes are in opposition to each other on an imaginary line substantially parallel to the longitudinal axis of the metal vapor discharge lamp, and the diffusing part is located inside an imaginary conical surface defined by connecting a periphery of the reflecting surface along an opening thereof to a tip of one of the pair of electrodes which is closer to the pinch seal part.

Or, the pair of electrodes are in opposition to each other on an imaginary line substantially orthogonal to the longitudinal axis of the metal vapor discharge lamp, and the diffusing part is located inside an imaginary conical surface defined by connecting a periphery of the reflecting surface along an opening thereof to the substantial center between the tips of the pair of electrodes.

Also, the above-mentioned object can be achieved by an illumination apparatus, comprising: a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein the outer tube has a surrounding member provided therein that surrounds at least part of the airtight container at a location away from the pinch seal part beyond an imaginary plane that passes through a substantial center between tips of the pair of electrodes and is substantially orthogonal to a longitudinal axis of the metal vapor discharge lamp.

With the above-mentioned construction, the light emitted from the arc tube in the directions except toward the reflecting surface is shielded by the surrounding member. As a result, the amount of the light emitted from the metal vapor discharge lamp in the directions except toward the reflecting surface can be reduced.

Moreover, the surrounding member includes: a plurality of through-holes; and a plurality of small pieces each of which covers a corresponding one of the plurality of through-holes without completely closing the through-hole. Or, the surrounding member includes: a plurality of through-holes for dissipating, to outside of the airtight container, heat generated from the arc tube when the meal vapor discharge lamp is lighted up; and a light shielding part for preventing light emitted from the arc tube in directions except toward the reflecting surface and passing through the through-holes from reaching the outer tube.

Also, the above-mentioned object can be achieved by a meal vapor discharge lamp including an arc tube having a pair of electrodes therein, an airtight container having a pinch seal part at one end and housing the arc tube therein, and an outer tube having a base at one end facing the pinch seal part and housing the airtight container therein, the meal vapor discharge lamp being used by being built into an open-type reflector that holds one end of the metal vapor discharge lamp facing the base of the outer tube, and has a concave reflecting surface that is shaped so that a concave diameter gradually expands from the base to an other end of the outer tube along a longitudinal direction of the outer tube, wherein the outer tube has a light reducing unit provided therein that reduces an amount of light emitted from the arc tube in directions except toward the reflecting surface, so that an amount of light emitted in the directions and passing through the outer tube is smaller than an amount of light emitted in the directions and entering the airtight container.

With the above-mentioned construction, the amount of the light emitted from the metal vapor discharge lamp in the directions except toward the reflecting surface can be reduced.

Effects of the Invention

In the illumination apparatus of the present invention, the amount of the light emitted from the metal vapor discharge lamp to an area excluding the reflecting surface of the reflector (i.e. in the directions except toward the reflecting surface) can be reduced. Therefore, direct light from the metal vapor discharge lamp is less likely to enter human eyes, and thus glare can be suppressed.

In the metal vapor discharge lamp of the present invention, the amount of the light directly emitted in the directions except toward the reflecting surface of the reflector is reduced, on the assumption that the metal vapor discharge lamp is used by being built into the reflector. Therefore, even if the metal vapor discharge lamp is used by being built into the open-type reflector having a concave reflecting surface, direct light from the metal vapor discharge lamp is less likely to enter human eyes, and thus glare can be suppressed.

DESCRIPTION OF REFERENCE NUMERALS

Figure 1:
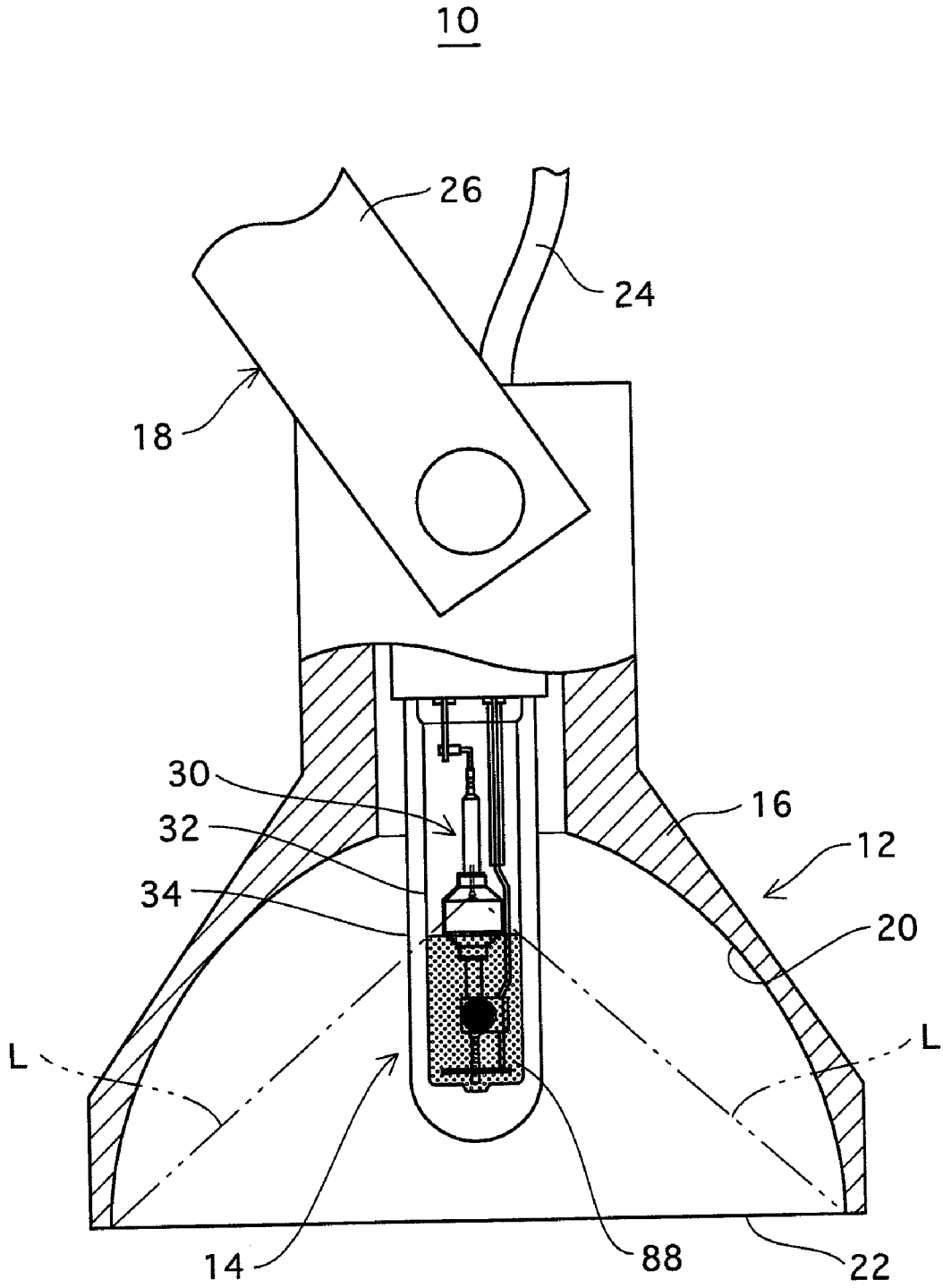
FIG. 1 is an overall view of an illumination apparatus of a first embodiment, which is partly cut away to show an inner structure of a reflector.

10 illumination apparatus
12 illumination fixture
14 metal halide lamp
16 reflector
30 arc tube
32 inner tube
34 outer tube
36 base
86 pinch seal part
88 diffusing part
120 surrounding member

BEST MODE FOR CARRYING OUT THE INVENTION

First Embodiment

The following describes an illumination apparatus and a metal halide lamp that is used as a light source of the illumination apparatus of a first embodiment, with reference to the attached drawings. Note that a light reducing unit of the present invention is composed of a diffusing part in the first embodiment.

1. Illumination Apparatus

FIG. 1 is an overall view of the illumination apparatus of the first embodiment, which is partly cut away to show an inner structure of a reflector.

As shown in FIG. 1, an illumination apparatus 10 includes an illumination fixture 12 and a metal halide lamp 14 that is built into the illumination fixture 12. Note that the illumination fixture 12 is used as a spotlight.

The illumination fixture 12 includes a reflector 16 that reflects forward light emitted from the metal halide lamp 14 arranged in the illumination fixture 12, a socket (not shown) which is built into the reflector 16 and to which the metal halide lamp 14 is attached, and an attachment 18 that attaches the reflector 16 to a wall or a ceiling.

As shown in FIG. 1, the reflector 16 includes a concave reflecting surface 20. The reflecting surface 20 is composed of, for example, an aluminum mirror. The reflector 16 holds a base side of the metal halide lamp 14, and the reflecting surface 20 is a concave curved surface that is shaped so that a concave diameter gradually expands from the base to a tip of the metal halide lamp 14 along a longitudinal direction of the metal halide lamp 14 that is held by the reflector 16. Note that the reflector 16 is a so-called (front surface) open-type reflector whose opening 22 (which is a light extracting part, and corresponds to "in the directions except toward the reflecting surface" in the present invention) is not closed with a glass plate or the like.

The base of the metal halide lamp 14 is electrically connected to the socket to supply power to the metal halide lamp 14. Note that a ballast (not shown) for lighting up the metal halide lamp 14 is, for example, embedded in a ceiling, and supplies power to the metal halide lamp 14 via a supply line 24 which will be described later.

The attachment 18 is, for example, in a shape of "U", and includes a pair of arms 26 (, 26) arranged in parallel with each other, and a connection part (not shown) which connect sends of each of the pair of arms 26 (, 26). The reflector 16 is rotatably pivotally supported by the arms 26 (, 26) in a state in which the reflector 16 is sandwiched between the pair of arms 26 (, 26), and the connection part is attached to, for example, a wall or a ceiling. Note that a direction of light illuminated from the illumination apparatus 10 can be adjusted by rotating the attachment 18 that is rotatable to the reflector 16.

2. Metal Halide Lamp

Figure 2:
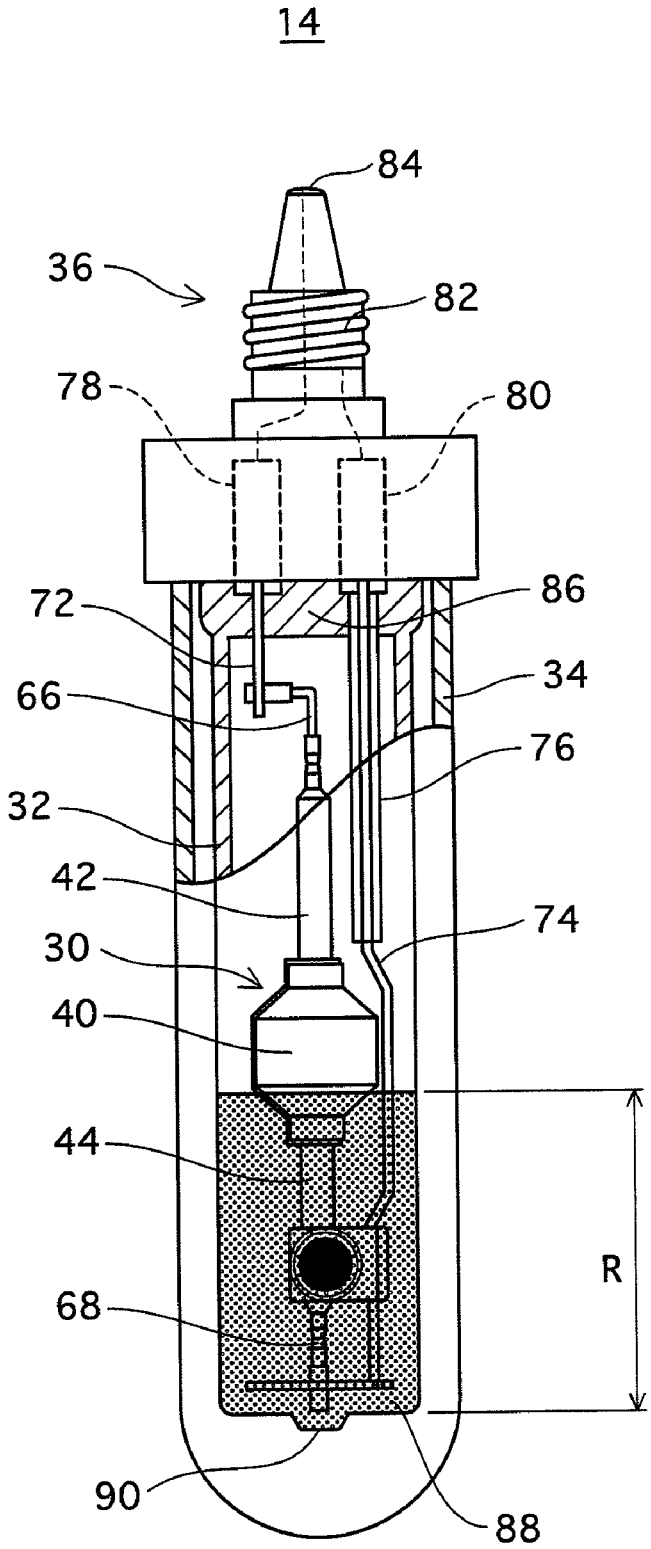
FIG. 2 is a front view of a metal halide lamp that is shown as an example of a metal vapor discharge lamp, which is partly cut away to show an inner structure.

FIG. 2 is a front view of the metal halide lamp that is shown as an example of a metal vapor discharge lamp, which is partly cut away to show an inner structure. Note that the metal halide lamp 14 which will be described here has a rated power of 70 [W], for example.

The metal halide lamp 14 has a triple tube structure, and includes an arc tube 30 which has therein a pair of electrodes and forms a discharge space, an inner tube 32 which is an airtight container for housing the arc tube 30, and an outer tube 34 which is a protective container covered on the inner tube 32. Also, the metal halide lamp 14 includes a base 36 for receiving power supplied by the socket of the illumination fixture 12. In the metal halide lamp 14, even if the arc tube 30 is damaged by some reasons and the inner tube 32 is damaged by a fragment of the damaged arc tube 30, the outer tube 34 is not generally damaged by the damage of the arc tube 30 because the metal halide lamp 14 includes the outer tube 34.

Figure 3:
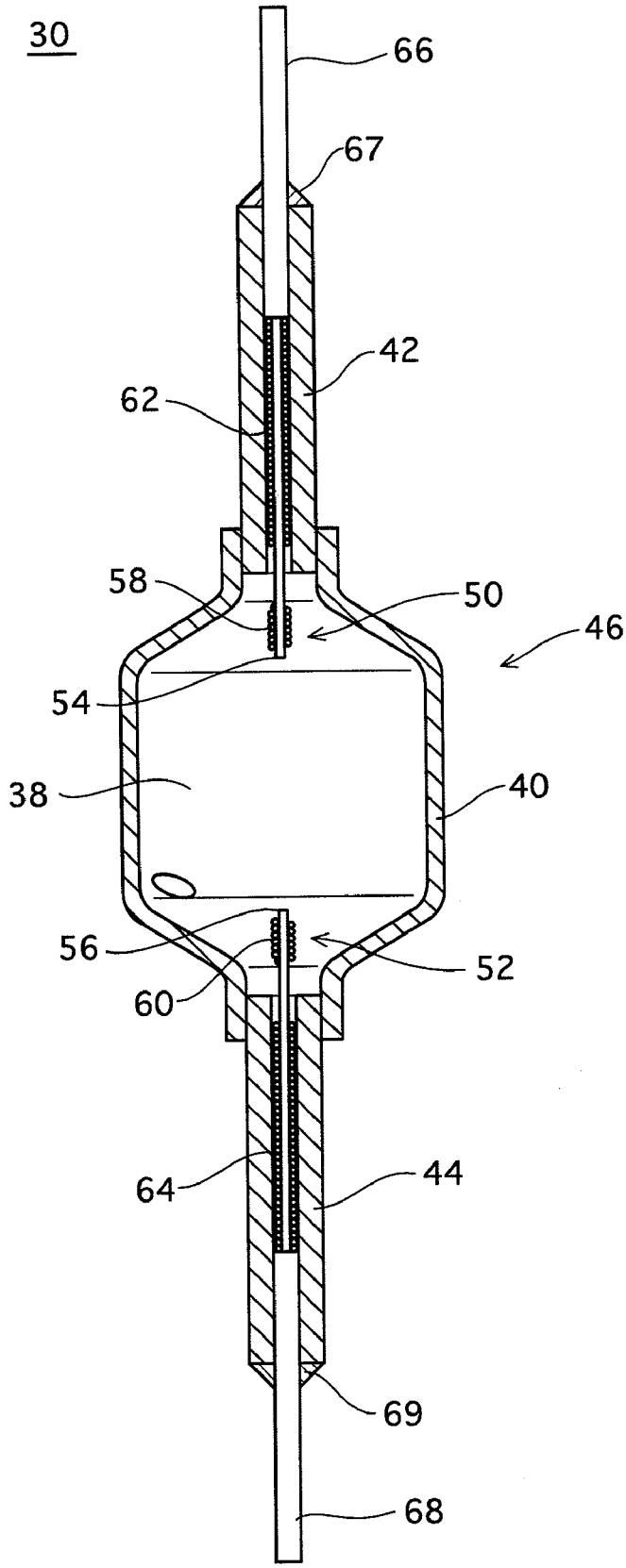
FIG. 3 is a front cross section view of an arc tube.

FIG. 3 is a front cross section view of the arc tube.

The arc tube 30 includes an enclosure 46 that is composed of a main tube part 40 which has therein a discharge space 38 that is hermetically sealed, and narrow tube parts 42 and 44 which are formed so as to extend to respective sides of the main tube part 40 in a tube axis direction thereof. The main tube part 40 and the narrow tube parts 42 and 44 are made from, for example, translucent ceramic. As the translucent ceramic, alumina ceramic can be used, for example. Note that the main tube part 40 and the narrow tube parts 42 and 44 can be composed of other ceramic, a quartz glass, or the like.

In the examples shown in FIGS. 2 and 3, the enclosure 46 is formed by the following way. After the main tube part 40 and the narrow tube parts 42 and 44 are individually formed, the main tube part 40 and the narrow tube parts 42 and 44 are integrated with each other by shrinkage fitting. However, the formation method of the enclosure 46 is not limited to this, and the enclosure 46 may be formed by integrally forming the main tube part and the two narrow tube parts.

The main tube part 40 includes a pair of electrodes 50 and 52 which are substantially in opposition to each other on a central axis in a longitudinal direction of the metal halide lamp 14 (herein after, referred to as "lamp axis") or on an axis parallel to the lamp axis in the discharge space 38. In the discharge space 38, predetermined amounts of metal halide as a light-emitting material, a rare gas as a starting gas, and mercury as a buffer gas are enclosed. As metal halide, sodium iodide, dysprosium iodide, or the like is used.

As shown in FIG. 3, the electrodes 50 and 52 include electrode rods 54 and 56, and electrode coils 58 and 60 each provided at respective ends of the electrode rods 54 and 56 facing the discharge space 38. In spaces between the electrode rods 54 and 56, and the narrow tube parts 42 and 44, molybdenum coils 62 and 64 are inserted so as to wind around the electrode rods 54 and 56 respectively, in order to prevent a light-emitting material from entering the spaces.

As mentioned above, the electrodes 50 and 52 are ideally (in design) arranged so as to be substantially in opposition to each other on the lamp axis, i.e. each of central axes of the electrode rods 54 and 56 is substantially arranged on the lamp axis. However, there is a case in which each of the central axes of the electrode rods 54 and 56 is not on the lamp axis, from a viewpoint of the accuracy of the process.

In the narrow tube parts 42 and 44, power supply parts 66 and 68 are inserted respectively, and ends of the power supply parts 66 and 68 are joined to the electrodes 50 and 52 respectively. The power supply parts 66 and 68 are sealed with sealing materials 67 and 69 which are made from frit and poured into ends of the narrow tube parts 42 and 44 away from the main tube part 40. Note that parts of the sealing materials 67 and 69 shown in FIGS. 2 and 3 are parts projected from the ends of the narrow tube parts 42 and 44.

Back to the explanation of the metal halide lamp 14, as shown in FIG. 2, an end of the power supply part 66 opposite to the electrode 50 is electrically connected to a power supply line 72. Similarly, an end of the power supply part 68 opposite to the electrode 52 is electrically connected to a power supply line 74. The power supply lines 72 and 74 are connected to an eyelet part 84 and a shell part 82 of the base 36 via metal foils 78 and 80 and the like respectively.

A sleeve 76 made from, for example, a quartz glass covers part of the power supply line 74 at a location closer to the base 36. More specifically, for example, the sleeve 76 covers a part of the power supply line 74 in opposition to the power supply line 72 and the power supply part 66 connected to the power supply line 72.

As shown in FIG. 2, the arc tube 30 and the like are housed in the inner tube 32 which is in a tubular shape, for example, in a cylindrical shape. The inner tube 32 is made from, for example, a quartz glass, and an end of the inner tube 32 facing the metal foils 78 and 80 (which corresponds to "one end" in the present invention) is pressed by a so-called pinch seal method, and a part of the end corresponding to the metal foils 78 and 80 is hermetically sealed.

Therefore, the inner tube 32 is a one-end sealed airtight container. Here, the part of the inner tube 32 which is pressed and sealed is referred to as a pinch seal part 86.

A diffusing part 88 is formed in an area R which is a part of an area between an end of the inner tube 32 opposite to the pinch seal part 86 (which corresponds to a lower end in FIG. 2) and a substantial center of the discharge space 38 in a longitudinal direction of the arc tube 30. The diffusing part 88 diffuses light which is not reflected by the reflecting surface 20 of the reflector 16 and goes toward the opening 22 of the reflector 16, out of light which is emitted from the arc tube 30 (which corresponds to "light emitted from the arc tube in directions except toward the reflecting surface" in the present invention). This diffusion can reduce an amount of light which is not reflected by the reflecting surface 20 after being emitted from the arc tube 30, goes toward the opening 22 of the reflector 16, and emitted through the outer tube 34 to less than an amount of light which enters the inner tube 32. (Therefore, the diffusing part 88 also corresponds to the "light reducing unit" in the present invention.)

The diffusing part 88 is formed, for example, by performing concavo-convex processing on an outer surface of the inner tube 32 corresponding to the area R. As shown in FIG. 1, it is preferable that the area R for the diffusing part 88 is located closer to the opening 22 of the reflector 16 than an imaginary line L. The imaginary line L is defined by connecting the electrode 50 which is closer to the base 36 of the metal halide lamp 14 than the other electrode (which corresponds to an end of the electrode rod 54 in a case of the electrode structure shown in FIG. 3) to a periphery of the opening 22 of the reflector 16.

The above concavity and convexity are formed so that a total light transmittance of the part in the inner tube 32 on which the concavo-convex processing is performed is in a range of 92 to 98 inclusive, when a total light transmittance of a part in the inner tube 32 on which the concavo-convex processing is not performed is 100.

A convex part 90 on a tip of the other end of the inner tube 32 in FIG. 2 is a chip-off part that is a remnant of an exhaust pipe used when inside of the inner tube 32 is vacuumed. The inside of the inner tube 32 is vacuumed in order to prevent oxidation of the power supply parts 66 and 68, and the power supply lines 72 and 74 and the like which are exposed to a high temperature when the lamp is lighted up. From a viewpoint of the prevention of oxidation, the inside of the inner tube 32 (and outside of the arc tube 30) can be filled with an inert gas, instead of being vacuumed.

As shown in FIGS. 2 and 3, the inner tube 32 is covered with the outer tube 34 that is in a shape of a cylinder with a bottom (i.e. in a cylindrical shape having one open end and one closed end). The outer tube 34 is made from, for example, a hard glass, and functions as a protective tube. In other words, even if the arc tube 30 is broken and the inner tube 32 is damaged, the outer tube 34 prevents a fragment of the damaged arc tube 30 and the inner tube 32 and the like from scattering. Note that inside of the outer tube 34 may be in a depressurized state, or may be filled with an inert gas. Furthermore, the inside and outside of the outer tube 34 may be in a communicating state, i.e. in an atmospheric state.

The outer tube 34 is in a tubular shape, for example, in a cylindrical shape same as the inner tube 32, in order to secure compactness of the lamp. Also, a gap between the outer tube 34 and the inner tube 32 is in a range of 1 mm to 2 mm inclusive on an average, in order to secure a clearance when the inner tube 32 is covered with the outer tube 34 in an assembling process. The base 36 is attached to an end of the outer tube 34 facing an opening of the outer tube 34.

3. Light Up a Lamp

Figure 4:
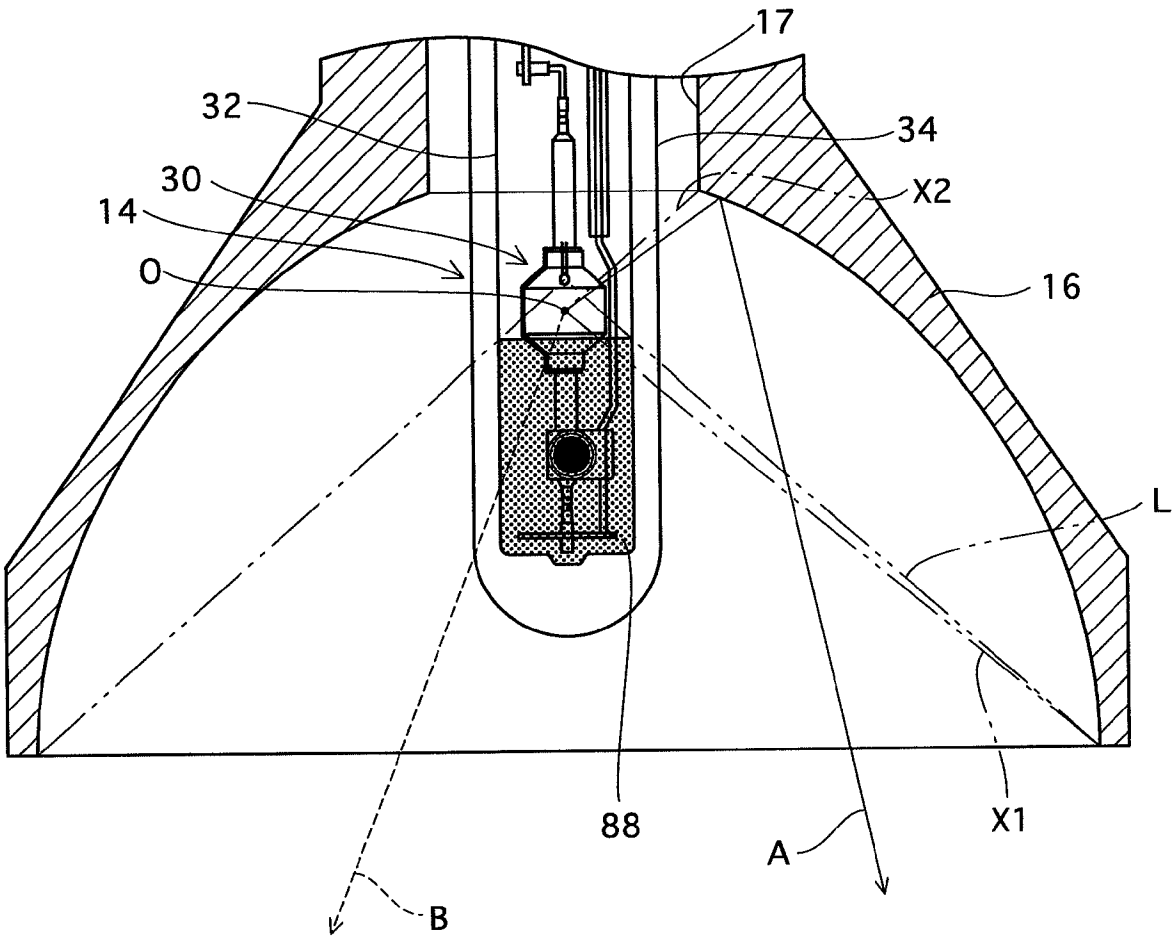
FIG. 4 is a diagram showing a light path when the lamp is lighted up.

FIG. 4 is a diagram showing a light path when the lamp is lighted up.

When the illumination apparatus 10 which uses the metal halide lamp 14 as a light source is lighted up, out of light which is emitted from the arc tube 30, light which is emitted to an area including the reflecting surface 20 of the reflector 16, i.e. light which is emitted to an area between an imaginary line X1 and an imaginary line X2 in FIG. 4 (for example, light indicated by a light path A in FIG. 4) is emitted from the metal halide lamp 14 through the inner tube 32 and the outer tube 34, reflected by the reflector 16, and illuminated forward from the illumination fixture 12.

Note that the imaginary line X1 connects a periphery of the reflecting surface 20 along the opening 22 to a substantial center O between the pair of electrodes 50 and 52. The imaginary line X2 connects a periphery of the reflecting surface 20 along an incorporating hole (a numeric symbol "17" in FIG. 4) in which the metal halide lamp 14 is incorporated to the substantial center O between the pair of electrodes 50 and 52.

On the other hand, out of the light which is emitted from the arc tube 30, light which goes toward an area excluding the reflecting surface 20 of the reflector 16, i.e. light which goes toward an area not between the imaginary line X1 and the imaginary line X2 in FIG. 4, and goes to the opening of the reflector 16 is diffused by the diffusing part 88 of the inner tube 32. Therefore, an amount of the light which is not reflected by the reflector 16 and directly illuminated from the illumination fixture 12 is reduced. As a result, glare is less likely to occur even if humans directly see the light source (metal halide lamp 14).

In detail, if the diffusing part 88 is not provided, the light which is emitted from the arc tube 30 to the area excluding the reflecting surface 20 of the reflector 16 is directly illuminated forward from the opening 22 of the reflector 16, as light indicated by a light path B in FIG. 4. However, if the diffusing part 88 is provided as in the first embodiment, the above light indicated by the light path B is diffused by the diffusing part 88 and is less likely to be directly illuminated forward from the reflector 16 (since light is diffused by the diffusing part, the light may be reflected by the reflector and emitted forward, or may be directly emitted forward from the reflector).

As mentioned above, the diffusing part 88 is formed in an area on a light path of light that is directly illuminated from the illumination fixture 12 to outside of the reflector 16, out of light that is emitted from the arc tube 30 (which corresponds to the area closer to the opening 22 of the reflector 16 than the imaginary line L in FIG. 1, and corresponds to the area R in FIG. 2). Therefore, direct light from the metal halide lamp 14 is less likely to enter human eyes, and thus glare can be suppressed.

On the other hand, the diffusing part 88 which diffuses light from the arc tube 30 is provided only in the area on the light path of the light that is directly illuminated from the illumination fixture 12 to the outside of the reflector 16. Therefore, light that is not directly illuminated from the illumination fixture 12 to the outside is reflected by the reflector 16 and indirectly illuminated from the illumination fixture 12 to the outside.

Moreover, out of the light which is diffused by the diffusing part 88, light which is diffused toward the reflector 16 is reflected to a front of the illumination fixture 12 by the reflector 16. Therefore, intensity is less reduced than a case where the area in which the diffusing part 88 is formed is covered with a glare cap.

4. Diffusing Part (1) Forming Position

Although the diffusing part 88 is formed on an outer surface of the inner tube 32 in the above description, the diffusing part 88 may be formed on a light path of light which is directly illuminated from the illumination fixture 12 to outside. For example, the diffusing part may be formed in an inner surface of the inner tube 32, or may be formed in an area of the outer tube 34 on the light path of the light which is directly illuminated from the illumination fixture 12 to the outside. In this case, the diffusing part may be formed on an inner surface and/or an outer surface of the outer tube 34. However, if concavo-convex processing is performed on the surface (outer surface) of the outer tube, the outer tube becomes easy to be broken.

Also, the area in which the diffusing part 88 is formed may be a total range of an area on the light path of the light which is directly illuminated from the illumination fixture 12 to the outside (which corresponds to "light emitted from the arc tube in directions except toward the reflecting surface" in the present invention), or may be only a part of the area (for example, only the tip of the other end of the inner tube). It goes without saying that when the diffusing part 88 is formed in the total range of the part on the light path, more glare can be suppressed.

(2) Structure

The diffusing part 88 is composed of the concavity and convexity formed on the outer surf ace of the inner tube 32 in the above description. However, the diffusing part may be composed of what can diffuse light emitted from the arc tube. For example, a diffusion film may be formed in the corresponding area in the inner tube. It is also proper that the diffusion film may be formed in the position described in the above (1) Forming position.

(3) Other

The inventors of the present invention concluded that the diffusing part was formed in the inner tube as a result of various investigations and tests. However, the inventors tried to form the diffusing part on the outer surf ace of the outer tube of the metal halide lamp made from a hard glass by sandblasting at the beginning of the investigations. Though, it was revealed that if the concave-convex diffusing part was formed on the outer surf ace of the outer tube, the outer tube was easily broken when a some sort of shock was given to the metal halide lamp (the outer tube). Therefore, the diffusing part was formed on the outer surf ace or the inner surface of the inner tube.

This can solve the problem that the outer tube is easily damaged. However, in view of workability, it is preferable to form the diffusing part on the outer surface of the inner tube. Especially, when the diffusing part is formed on the outer surface of the inner tube, it is easier to process the outer surface of the inner tube than to process the inner surface of the outer tube, and an effect of reducing a processing area can be obtained.

Second Embodiment

The following describes a metal halide lamp of a second embodiment of the present invention, with reference to the attached drawings.

In the first embodiment, the diffusing part 88 is formed in the inner tube 32. However, a light reducing unit of the present invention is composed of a surrounding member which shields light from the arc tube in the second embodiment.

1. Metal Halide Lamp

Figure 5:
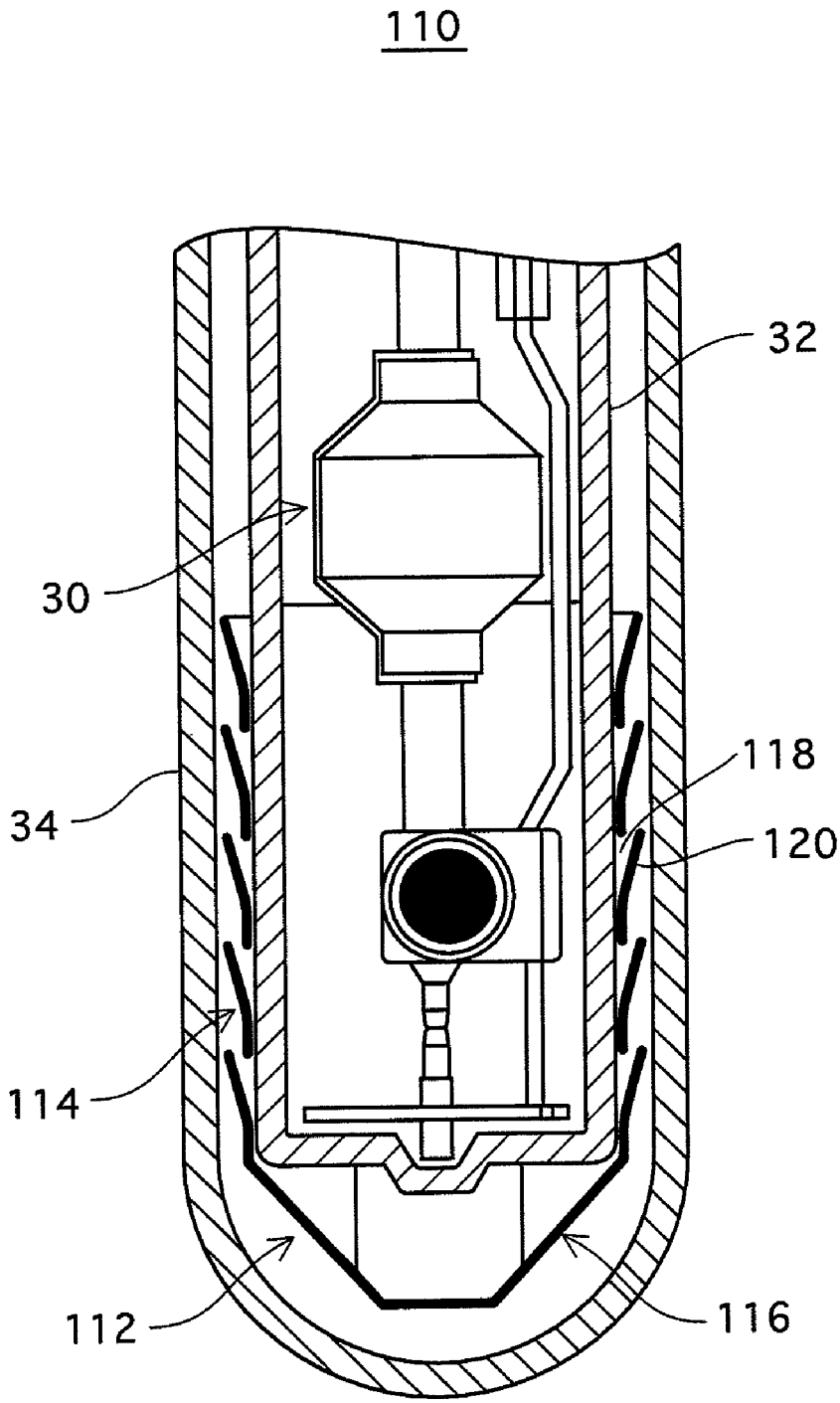
FIG. 5 is an enlarged front cross section view of a metal halide lamp of a second embodiment.

FIG. 5 is an enlarged front cross section view of the metal halide lamp of the second embodiment.

As shown in FIG. 5, a metal halide lamp 110 includes a surrounding member 112 which covers a tip of the inner tube 32 (a lower end of the inner tube 32 in FIG. 5), in addition to the arc tube 30, the inner tube 32, the outer tube 34, and the base 36 same as in the first embodiment.

In the second embodiment, the same symbols as in the first embodiment are assigned to component parts having the substantially same functions. Also, in the second embodiment, inside of the outer tube 34, i.e. a space between the inner tube 32 and the outer tube 34 is in a communicating state with atmosphere, or in a state in which air is enclosed at an atmospheric pressure.

Figure 6:
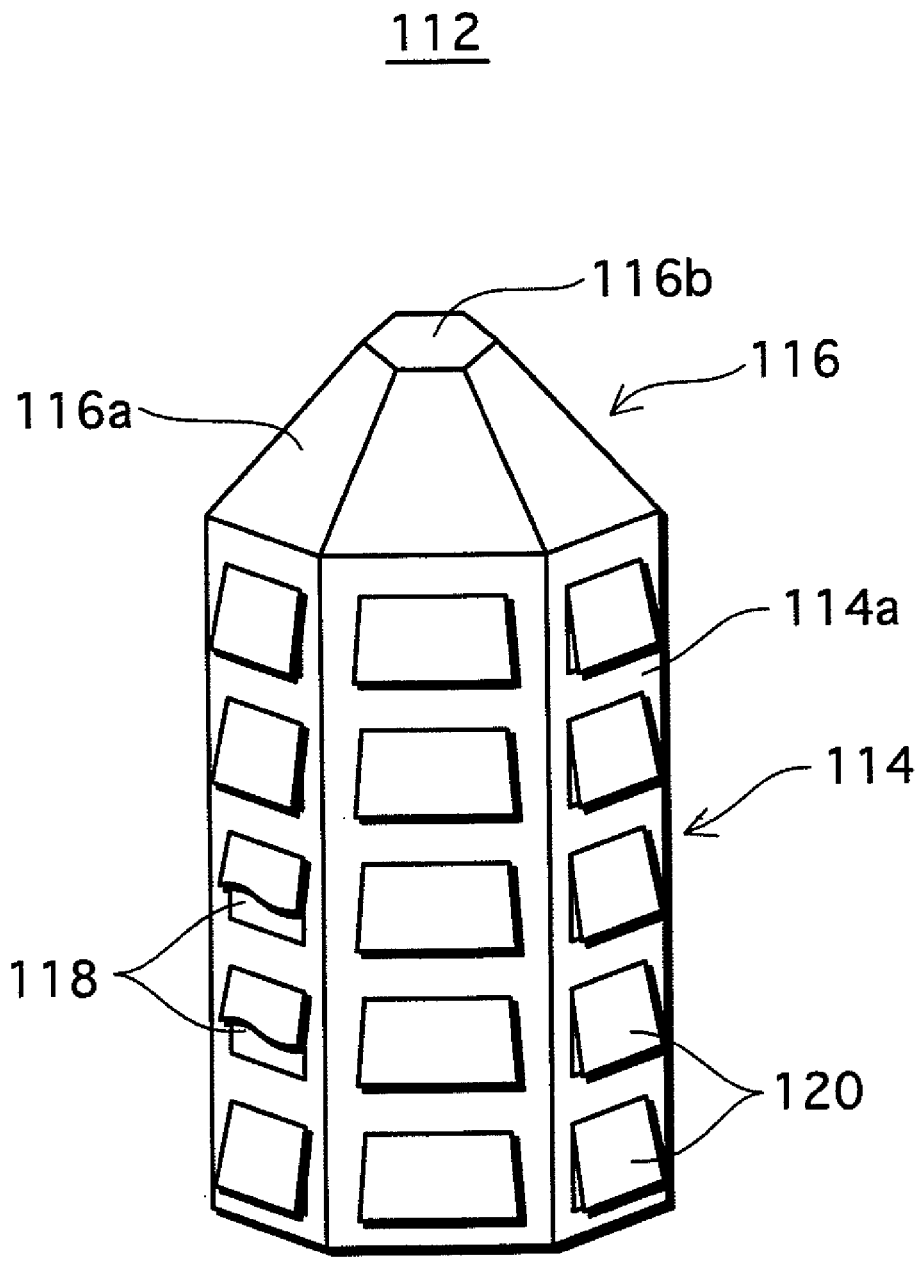
FIG. 6 is an enlarged perspective view of a surrounding member.

FIG. 6 is an enlarged perspective view of the surrounding member.

As shown in FIG. 6, the surrounding member 112 is in a cylindrical shape having one closed end, and includes a cylindrical part 114 whose cross section is in a hexagon shape, and a cover part 116 which is provided at the one end of the cylindrical part 114 and is in a truncated six-sided pyramid shape.

As shown in FIGS. 5 and 6, a heat radiation hole 118 is provided in the cylindrical part 114. Also, the cylindrical part 114 includes a light shielding piece 120. The heat radiation hole 118 (which corresponds to a "through-hole" in the present invention) dissipates heat generated when the arc tube 30 is lighted up to outside of the surrounding member. The light shielding piece 120 (which corresponds to a "small piece" and a "light shielding part" in the present invention) prevents light, which is emitted from the arc tube 30, directly goes toward the opening of the reflector, and passes through the heat radiation hole 118, from reaching the outer tube 34.

The heat radiation hole 118 is formed in a square shape, and the light shielding piece 120 is formed by punching three sides out of four sides of the heat radiation hole 118 and bending the remaining one side. The remaining one side is on the tip side of the other end of the inner tube 32 (opposite to the base 36) in a longitudinal direction thereof.

The light shielding piece 120 covers the heat radiation hole 118 so as not to completely close the heat radiation hole 118. As described above, the light shielding piece 120 prevents the following light from reaching human eyes directly from the outer tube 34. The light is emitted from the arc tube 30, directly goes toward the opening of the reflector without being reflected by the reflecting surface of the reflecting mirror, and passes through the heat radiation hole 118. Also, the light shielding piece 120 inclines at an angle (this angle can be calculated based on the reflecting surface, a distance between electrodes, or the like) that can prevent the light which passes through the heat radiation hole 118 from reflecting to the reflector, so as to stick out to outside of the surrounding member 112. The light shielding piece 120 inclines so as to be away from a central axis of the surrounding member 112 from the cover part 116 to the opening of the surrounding member 112.

The following specifically describes the surrounding member 112.

The surrounding member 112 is made from SUS having a thickness of 0.25 mm. The cylindrical part 114 is in a regular hexagon shape whose one side is 8.2 mm in a plan view, in which six side surfaces 114*a*, each of which is in a rectangle shape whose shorter side is the one side of the regular hexagon, are connected to each other in a circumferential direction of the cylindrical part 114. Note that the rectangle shape has a width (shorter side) of 8.2 (mm) and a length (longer side) of 25 (mm).

As mentioned above, the cover part 116 is in a truncated six-sided pyramid shape. Also, in a plan view, a truncated part which is an upper base is in a regular hexagon shape whose one side is 2.5 (mm), a lower base part is in a regular hexagon shape whose one side is 8.2 (mm), and a height between the upper base and the lower base in a side view is 7 (mm). In detail, sides of six trapezoids 116*a* each having an upper base of 2.5 mm, a lower base of 8.2 mm, and a height of 7 mm are connected to each other, and the upper bases of the connected six trapezoids 116*a* are covered with a regular hexagon 116*b* whose one side is 2.5 (mm).

For each of the six side surfaces 114*a* of the cylindrical part 114, five heat radiation holes 118 in a rectangle shape each having a width of 6.75 mm and a height of 3 mm are provided in a longitudinal direction of the cylindrical part 114. On the cover part 116 side of the surrounding member 112 in each of the heat radiation holes 118, the light shielding piece 120 having a same size as the heat radiation hole 118 is provided, and the light shielding piece 120 inclines outward at an angle of approximately 10 degrees.

2. Light Up Lamp

When the illumination apparatus which uses the metal halide lamp 110 having the above-mentioned structure as a light source is lighted up, out of light emitted from the arc tube 30, an amount of light which is not reflected by the reflector 16 of the illumination fixture 12 and is directly illuminated from the illumination fixture 12 becomes small, and glare is less likely to occur even if humans directly see the light source, same as in the first embodiment. The following describes a reason why glare is less likely to occur, with reference to the attached drawings.

Figure 7:
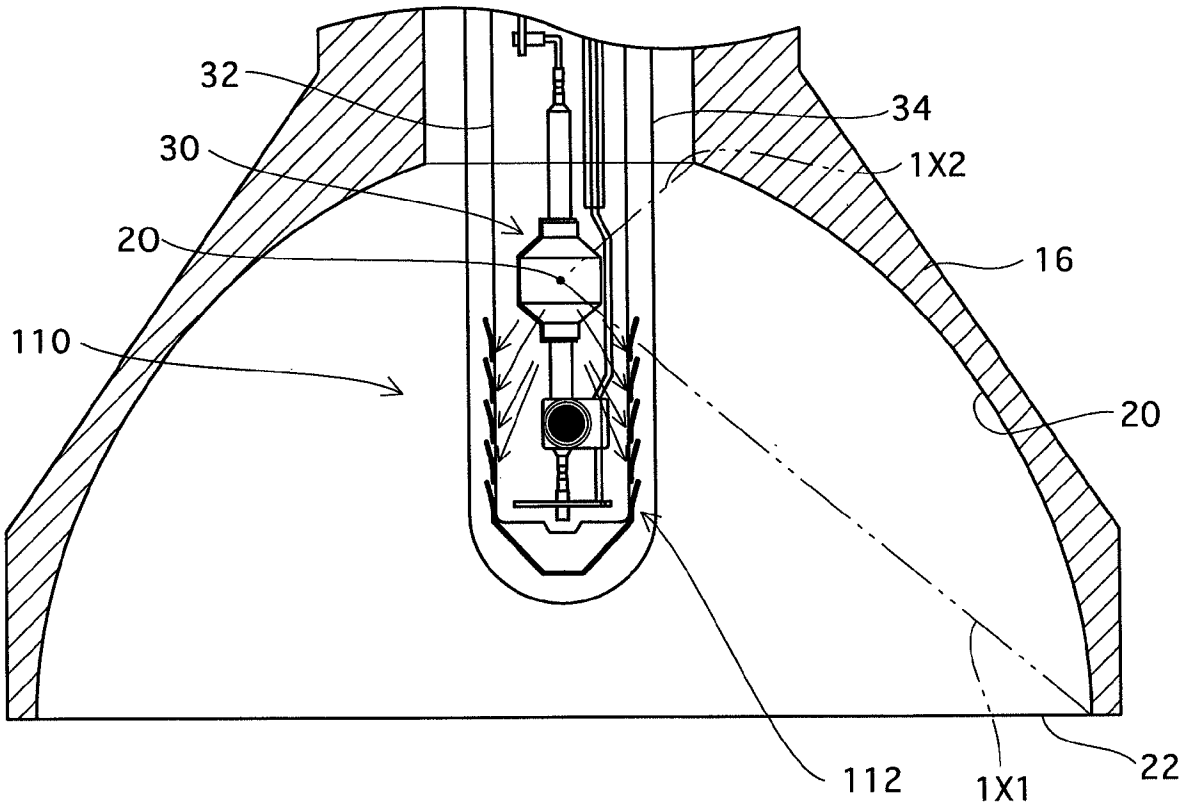
FIG. 7 is a diagram showing a light path when the lamp is lighted up.

FIG. 7 is a diagram showing a light path when the lamp is lighted up.

Out of light which is emitted from the arc tube 30, light which goes toward an area including the reflecting surface 20 of the reflector 16, i.e. light which goes toward an area between an imaginary line 1X1 and an imaginary line 1X2 in FIG. 7 passes through the inner tube 32 and the outer tube 34. Then, the light is reflected by the reflector 16, and illuminated forward (toward the opening 22) from the illumination fixture 12 (same as the light path A in FIG. 4).

Note that the imaginary line 1X1 and the imaginary line 1X2 are same as the imaginary line X1 and the imaginary line X2 in the first embodiment (FIG. 4), and a numeric symbol "2O" in FIG. 7 is a substantial center between the pair of electrodes 50 and 52.

On the other hand, out of the light which is emitted from the arc tube 30, light which goes toward an area excluding the reflecting surface 20 of the reflector 16, i.e. light which goes toward an area which is not between the imaginary line 1X1 and the imaginary line 1X2 in FIG. 7, and corresponds to the opening 22 of the reflector 16, is directly illuminated forward from the opening 22 of the reflector 16, as shown by the light path B in FIG. 4, if the surrounding member 112 is not provided. However, if the surrounding member 112 is provided in the outer tube 34 as in the second embodiment, the above light is shielded by the light shielding piece 120 of the surrounding member 112. Therefore, the light is less likely to be directly illuminated from the illumination fixture 12 to outside through the outer tube 34.

As mentioned above, the surrounding member 112 is provided so as to extend over an area of the inner tube 32 on a light path of light that is directly illuminated from the illumination fixture 12 to outside, out of light emitted from the arc tube 30. Therefore, direct light from the metal halide lamp is less likely to enter human eyes, and thus glare can be suppressed.

On the other hand, light which passes through the heat radiation hole 118 is absorbed by the light shielding piece 120, but light which has not been absorbed by the light shielding piece 120 is reflected to the base 36 by the light shielding piece 120. Because nearly all the reflected light goes toward an area of the reflector in which the metal halide lamp 110 is held, light distribution characteristics of the illumination apparatus have less effect.

For example, if a material such as SUS, Al, or the like is used for the surrounding member 112, and the outer tube 34 is filled with air (or is in a communicating state with outside), a surface of the surrounding member 112 is oxidized because of aging such as a lighting test of the lamp, and the light which passes through the heat radiation hole 118 can be prevented from reflecting.

After that, the oxidization of the surface of the surrounding member 112 does not proceed because of the lighting of the lamp. Therefore, a reflectance of the light shielding piece 120 becomes substantially constant, and the illumination apparatus can maintain the same light distribution characteristics as at the beginning of the lighting for a long period.

3. Surrounding Member (1) Surrounding Area

Although the surrounding member 112 is provided so as to surround an outer peripheral surface of the inner tube 32 as described above, the surrounding area is not limited to this and may be on a light path of light which is directly illuminated from the illumination fixture 12 to outside.

Therefore, the surrounding member may be provided, for example, inside of the inner tube 32. However, if the surrounding member is composed of a material having a conductive property, it is required not to contact with a power supply line, or it is required to perform insulation processing on a material of either the surrounding member or the power supply line. Moreover, outside of the outer tube may be covered with the surrounding member. However, design of the lamp becomes worse and it is required to take a measure to prevent the surrounding member from coming off from the outer tube.

Also, the surrounding area may be a total range of the area on the light path of light which is directly illuminated from the illumination fixture 12 to outside, or may be a part of the area. It goes without saying that when the surrounding member is provided so as to surround the total range of the area, more glare can be suppressed.

(2) Shape

Although the cross section of the cylindrical part of the surrounding member is in a hexagon shape in the above description, the cross section of the cylindrical part may be in other shape, such as an ellipse (including a circle), a polygon, or the like. Note that when the cross section of the cylindrical part is in a polygonal shape, it is preferable to be a polygonal shape of pentagon or more, in view of uneven reflection of light.

Also, the heat radiation hole may be in other shape, such as an ellipse (including a circle), a semiellipse (including a semicircle), or a polygon.

Moreover, the surrounding member may be composed of, for example, only a cylindrical part. In this case, it is not important whether or not the heat radiation hole is formed in the cylindrical part. This is because of the following reason. Since such a surrounding member does not have a cover part unlike the surrounding member in the second embodiment, heat generated when a lamp is lighted up is dissipated from an open end. Obviously, the surrounding member can be composed of only a cover part. However, it goes without saying that the surrounding member which is composed of only the cylindrical part or the cover part cannot obtain a same effect of suppressing glare as the surrounding member described in the second embodiment.

(3) Material

Although the material of the surrounding member is a metal material as mentioned above, it is obvious that the surrounding member can be composed of other material such as ceramic. Note that it is preferable that the surrounding member is composed of a material having worse light transmission characteristics than a material which composes the inner tube. Moreover, the surrounding member may be composed of, for example, a quartz glass, and the diffusing part described in the first embodiment may be formed on a wall surface of the surrounding member.

(4) Light Shielding Piece

The surrounding member 112 includes the light shielding piece 120 as mentioned above. However, glare can be suppressed without the light shielding piece 120 as follows. If there is a peripheral wall of the cylindrical part, light which is directly illuminated from the illumination fixture 12 to outside can be shielded even if the heat radiation hole is formed in the peripheral wall, for example. Since light which passes through the heat radiation hole is illuminated from the illumination fixture 12 to outside, an effect of suppressing glare by the surrounding member is worse than the effect described in the second embodiment.

4. Other

The inventors of the present invention concluded that the surrounding member was provided in the outer tube as a result of various investigations and tests. However, the inventors tried to provide the surrounding member on an outer surface of the outer tube of the metal halide lamp at the beginning of the investigations. Though, it was revealed that if the surrounding member was provided on the outer surface of the outer tube of the metal halide lamp, the following problems arose. The metal halide lamp itself may become larger, or the surrounding member may come off from the outer surface of the outer tube of the metal halide lamp.

Therefore, the inventors provided the surrounding member between an inner periphery of the outer tube and the outer surface of the inner tube. A cylindrical part of the surrounding member is slightly elastically deformable in a circumferential direction thereof, and the inner tube is covered by the cylindrical part of the surrounding member by taking advantage of this spring function. As a result, the surrounding member can be provided in the outer tube easily. In addition, because the surrounding member is in the outer tube, even if the surrounding member comes off from the inner tube, the surrounding member may not come off from the metal halide lamp.

Also, a surrounding member at the beginning of the development did not have the heat radiation hole 118 in the surrounding member 112 in the second embodiment. However, when the surrounding member which did not have the heat radiation hole 118 was used, a leak occurred in the metal halide lamp, i.e. in the inner tube or the arc tube. As a result of an investigation of this problem, the inventors proved that this problem was caused by a temperature when the metal halide lamp was lighted up. In detail, if the surrounding member which did not have the heat radiation hole was provided heat generated when the metal halide lamp was lighted up was not dissipated, and the heat was accumulated in the surrounding member. As a result, a temperature in the arc tube and the inner tube rose, and the leak occurred in the sealing part.

As mentioned above, when focusing on only the suppression of glare, it is preferable that the cylindrical part 114 does not have the through-hole. Also, in view of only the radiation performance, it is preferable that the through-hole is provided on the peripheral wall. The surrounding member in the second embodiment has the heat radiation hole to suppress an increase in temperature in the inner tube and the like, and further shields light which passes through the heat radiation hole by the light shielding piece to solve these problems.

<Other>

1. Metal Halide Lamp

In the metal halide lamp of each of the first and second embodiments, the pair of electrodes 50 and 52 (electrode rods) extend in a direction parallel to the axis of the metal halide lamps and tips of the pair of electrodes 50 and 52 are substantially in opposition to each other on the axis of the metal halide lamp. However, other type of metal halide lamp may be used.

Figure 8:
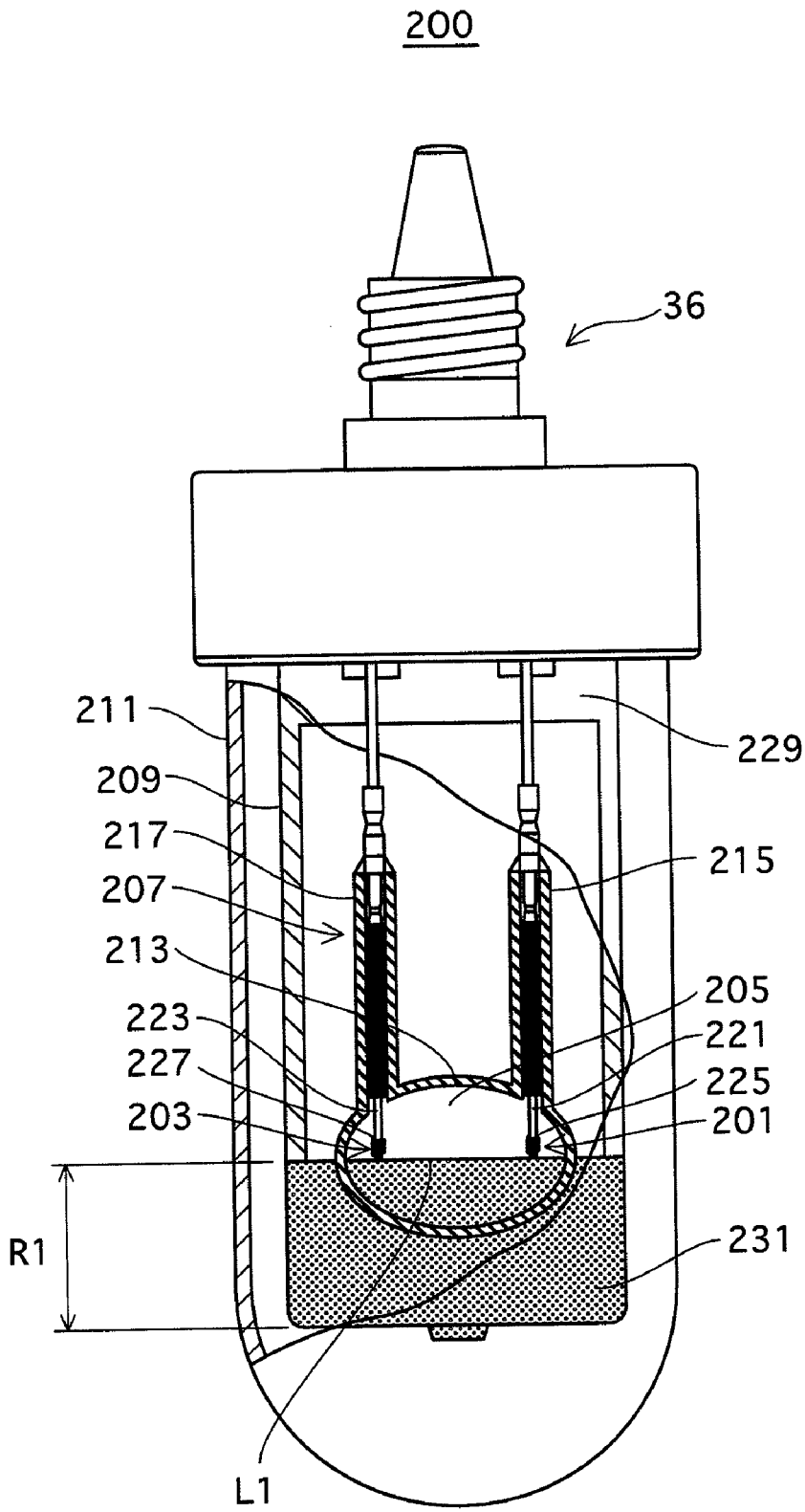
FIG. 8 is a front view of a metal halide lamp of a modification, which is partly cut away to show an inner structure.

FIG. 8 is a front view of a metal halide lamp of a modification, which is partly cut away to show an inner structure.

As shown in FIG. 8, a metal halide lamp 200 has a triple tube structure, and includes an arc tube 207 which has a pair of electrodes 201 and 203 in a discharge space 205 therein, an inner tube 209 which is an airtight container for housing the arc tube 207, and an outer tube 211 which is a protective container covered on the inner tube 209. Also, the metal halide lamp 200 includes the base 36 for receiving power supplied by the socket of an illumination fixture.

The arc tube 207 includes an enclosure which is composed of a container part 213 having therein the discharge space 205 which is hermetically sealed, and narrow tube parts 215 and 217 which are formed in the container part 213.

As can be expected from FIG. 8, the container part 213 is in a shape of a substantially elliptical sphere, and is housed in the inner tube 209 so that a long axis of the container part 213 is substantially orthogonal to a lamp axis of the metal halide lamp. The narrow tube parts 215 and 217 extend from the container part 213 in a direction orthogonal to the long axis of the container part 213 (i.e. in a direction parallel to the lamp axis) toward outside of the container part 213.

The container part 213 and the narrow tube parts 215 and 217 are made from, for example, translucent ceramic. In the discharge space 205, predetermined amounts of metal halide, a rare gas, and mercury are enclosed same as in the first embodiment.

Same as in the first embodiment, the pair of electrodes 201 and 203 include electrode rods 221 and 223, and electrode coils 225 and 227 each provided at respective ends of the electrode rods 221 and 223 facing the discharge space 205. Also, each of the opposite ends of the electrode rods 221 and 223 is connected to a power supply part same as in the first embodiment.

The electrode rods 221 and 223 of the pair of electrodes 201 and 203 are extended in a direction parallel to the lamp axis, and sealed to the narrow tube parts 215 and 217 respectively so that an imaginary line segment connecting the respective ends of the electrodes 201 and 203 facing the discharge space 205 is substantially orthogonal to the lamp axis. Note that the electrodes 201 and 203 are sealed to the narrow tube parts 215 and 217 respectively in the same manner as in the first embodiment.

Also, in spaces between the electrode rods 221 and 223, and the narrow tube parts 215 and 217, molybdenum coils are inserted to prevent a light-emitting material from entering the spaces, same as in the first embodiment. Note that the electrodes 201 and 203 are electrically connected to the base 36 via a metal foil.

As shown in FIG. 8, the arc tube 207 and the like are housed in the inner tube 209 which is in a tubular shape, for example, in a cylindrical shape whose cross section is in a circle shape. The inner tube 209 is made from, for example, a quartz glass, and an end of the inner tube 209 facing the metal foil (which corresponds to "one end" in the present invention) is a pinch seal part 229 same as in the first embodiment.

In the inner tube 209, a diffusing part 231 is formed in an area R1 between the end of the inner tube 209 opposite to the pinch seal part 229 (which corresponds to a lower end in FIG. 8) and an imaginary line segment L1 connecting the respective ends of the electrodes 201 and 203 facing the discharge space 205.

Figure 9:
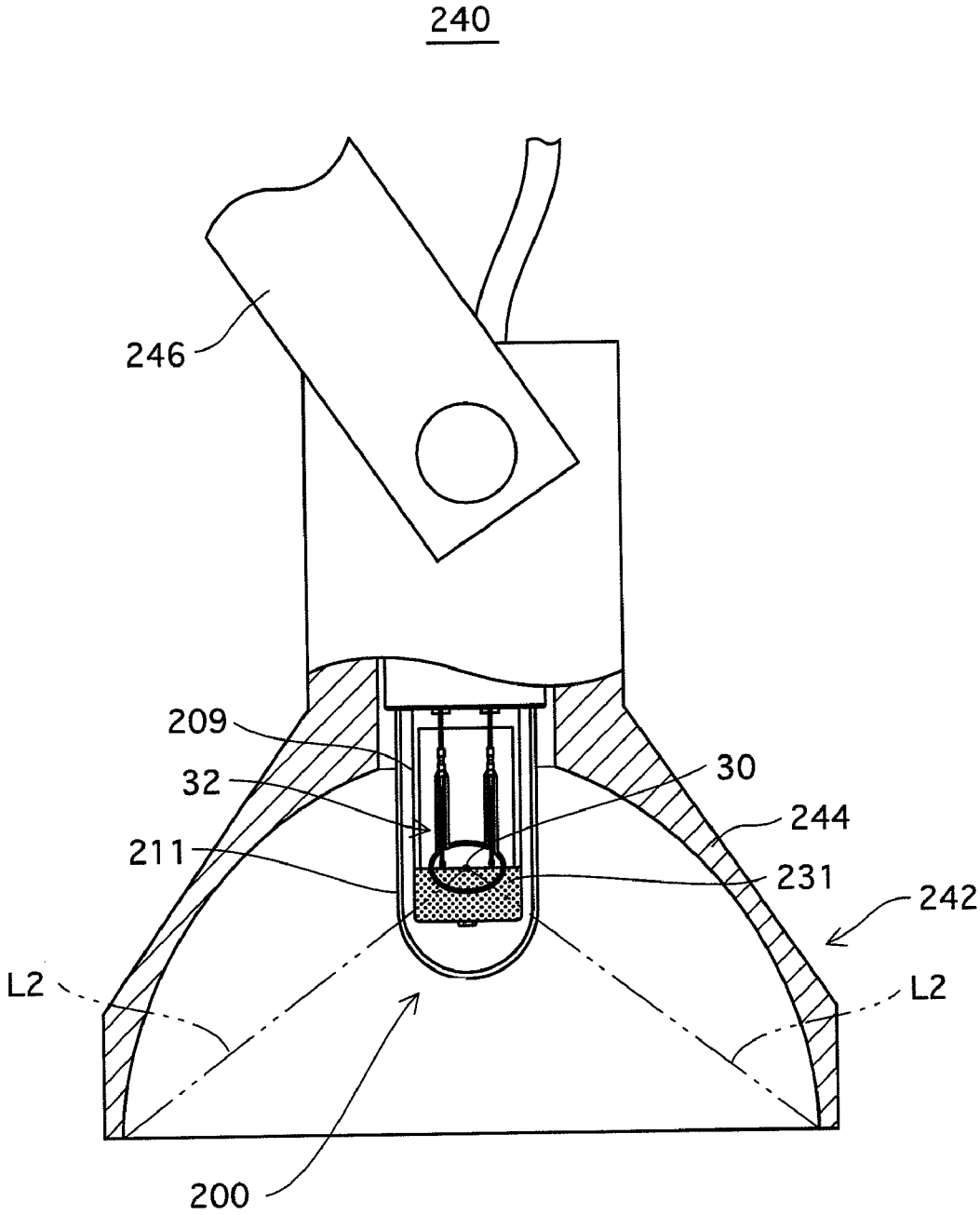
FIG. 9 is an overall view of an illumination apparatus of the modification, which is partly cut away to show an inner structure of a reflector.

FIG. 9 is an overall view of an illumination apparatus of the modification, which is partly cut away to show an inner structure of a reflector.

As shown in FIG. 9, an illumination apparatus 240 includes an illumination fixture 242 and the metal halide lamp 200 which is built into the illumination fixture 242. Note that the illumination apparatus 240 is used as a spotlight, and is an open type.

The illumination fixture 242 includes a reflector 244, a socket (not shown), and an attachment 246, same as in the first embodiment.

As mentioned above, the area R1 in which the diffusing part 231 is formed is a part of the inner tube 209 between the lower end of the inner tube 209 and the imaginary line segment L1 connecting the respective ends of the electrodes 201 and 203 facing the discharge space 205 as shown in FIG. 8. However, in a relationship with the illumination fixture 242, it is preferable that the area R1 includes the following area of the inner tube 209 as shown in FIG. 9. The area is closer to an opening of the reflector 244 than an imaginary line L2 connecting a substantial center 3O between the electrodes 201 and 203 on the imaginary line segment L1 to a periphery of the opening of the reflector 244 (periphery of the reflecting surface along the opening thereof), in a state in which the metal halide lamp 200 is built into the illumination fixture 242. In other words, it is preferable that the diffusing part 231 is formed at least in an inner area of an imaginary conical surface which is formed by connecting the substantial center 3O between the electrodes 201 and 203, and the periphery of the reflecting surface along the opening thereof.

The present invention can be applied to the metal halide lamp 200 having the above mentioned electrode structure. Also, the surrounding member described in the second embodiment can be provided in the metal halide lamp having the electrode structure described in the modification. In this case, it is preferable that the surrounding area includes at least the area of the inner tube 209 closer to the opening of the reflector 244 than the imaginary line L2 connecting the substantial center 3O between the electrodes 201 and 203 on the imaginary line segment L1 to the periphery of the opening of the reflector 244, in a state in which the metal halide lamp 200 is built into the illumination fixture 242. In other words, it is preferable that the surrounding area surrounds at least the inner area of the imaginary conical surface which is formed by connecting the substantial center 3O between the electrodes 201 and 203 to the periphery of the reflecting surface along the opening thereof.

2. Electrode

In each of the first and second embodiments and the modification, the electrode has the structure in which the electrode coil is attached to one end of the electrode rod. Such an electrode includes the following types. For example, a tip of the electrode rod sticks out to the opposite electrode more than the electrode coil as shown in FIG. 3, or the tip of the electrode rod is in the electrode coil.

The tip of the electrode in the present invention is in a position substantially on a central axis or on an extension of the central axis in a part of the electrode rod to which the electrode coil is attached, and at the position, a distance between the electrodes in the electrode rod or the electrode coil is the shortest. Also, the position is a starting point of a discharge (arc) in the design of the lamp.

Therefore, in the electrode in which the tip of the electrode rod sticks out from the electrode coil, the tip of the electrode is in a position on a central axis in a part of the electrode rod to which the electrode coil is attached, and the position is closest to the opposite electrode. On the other hand, in the electrode in which the tip of the electrode rod is in the electrode coil, the tip of the electrode is a position on an extension of a central axis in a part of the electrode rod to which the electrode coil is attached, and the position is closest to the opposite electrode. Note that in the case of an electrode which does not have the above mentioned structure, the same definition of the tip of the electrode can be applied.

INDUSTRIAL APPLICABILITY

The present invention can be used for a high-efficiency metal vapor discharge lamp and an illumination apparatus which can take measures against glare, even if an open-type reflector is used.

The invention claimed is:

1. An illumination apparatus, comprising:

a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein the outer tube has a light reducing unit provided therein that reduces an amount of light emitted from the arc tube in directions except toward the reflecting surface, so that an amount of light emitted in the directions and passing through the outer tube is smaller than an amount of light emitted in the directions and entering the airtight container.

2. An illumination apparatus, comprising:

a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein at least a part of the airtight container is a diffusing part that diffuses light emitted from the arc tube in directions except toward the reflecting surface, the part being away from the pinch seal part beyond an imaginary plane that passes through a substantial center between tips of the pair of electrodes and is substantially orthogonal to a longitudinal axis of the metal vapor discharge lamp.

3. The illumination apparatus of claim 2, wherein the airtight container is composed of a quartz glass, and the diffusing part is composed of concavity and convexity formed on an inner surface and/or an outer surface of the airtight container.

4. The illumination apparatus of claim 2, wherein the pair of electrodes are in opposition to each other on an imaginary line substantially parallel to the longitudinal axis of the metal vapor discharge lamp, and the diffusing part is located inside an imaginary conical surface defined by connecting a periphery of the reflecting surface along an opening thereof to a tip of one of the pair of electrodes which is closer to the pinch seal part.

5. The illumination apparatus of claim 3, wherein the pair of electrodes are in opposition to each other on an imaginary line substantially parallel to the longitudinal axis of the metal vapor discharge lamp, and the diffusing part is located inside an imaginary conical surface defined by connecting a periphery of the reflecting surface along an opening thereof to a tip of one of the pair of electrodes which is closer to the pinch seal part.

6. The illumination apparatus of claim 2, wherein the pair of electrodes are in opposition to each other on an imaginary line substantially orthogonal to the longitudinal axis of the metal vapor discharge lamp, and the diffusing part is located inside an imaginary conical surface defined by connecting a periphery of the reflecting surface along an opening thereof to the substantial center between the tips of the pair of electrodes.

7. The illumination apparatus of claim 3, wherein the pair of electrodes are in opposition to each other on an imaginary line substantially orthogonal to the longitudinal axis of the metal vapor discharge lamp, and the diffusing part is located inside an imaginary conical surface defined by connecting a periphery of the reflecting surface along an opening thereof to the substantial center between the tips of the pair of electrodes.

8. An illumination apparatus, comprising:

a metal vapor discharge lamp including an arc tube having a pair of electrodes therein, an airtight container having a pinch seal part at one end and housing the arc tube therein, and an outer tube having a base at one end facing the pinch seal part and housing the airtight container therein; and an open-type reflector that holds one end of the metal vapor discharge lamp facing the base of the outer tube, and has a concave reflecting surface that is shaped so that a concave diameter gradually expands from the base to an other end of the outer tube along a longitudinal direction of the metal vapor discharge lamp, wherein the outer tube has a surrounding member provided therein that surrounds at least part of the airtight container at a location away from the pinch seal part beyond an imaginary plane that passes through a substantial center between tips of the pair of electrodes and is substantially orthogonal to a longitudinal axis of the metal vapor discharge lamp.

9. The illumination apparatus of claim 8, wherein the surrounding member includes:

a plurality of through-holes; and a plurality of small pieces each of which covers a corresponding one of the plurality of through-holes without completely closing the through-hole.

10. The illumination apparatus of claim 8, wherein the surrounding member includes:

a plurality of through-holes for dissipating, to outside of the airtight container, heat generated from the arc tube when the meal vapor discharge lamp is lighted up; and a light shielding part for preventing light emitted from the arc tube in directions except toward the reflecting surface and passing through the through-holes from reaching the outer tube.

11. A metal vapor discharge lamp including an arc tube having a pair of electrodes therein, an airtight container having a pinch seal part at one end and housing the arc tube therein, and an outer tube having a base at one end facing the pinch seal part and housing the airtight container therein, the metal vapor discharge lamp being used by being built into an open-type reflector that holds one end of the metal vapor discharge lamp facing the base of the outer tube, and has a concave reflecting surface that is shaped so that a concave diameter gradually expands from the base to an other end of the outer tube along a longitudinal direction of the outer tube, wherein the outer tube has a light reducing unit provided therein that reduces an amount of light emitted from the arc tube in directions except toward the reflecting surface, so that an amount of light emitted in the directions and passing through the outer tube is smaller than an amount of light emitted in the directions and entering the airtight container.

* * * * *